United States Patent [19]

Coleman

[11] Patent Number: 4,601,954

[45] Date of Patent: Jul. 22, 1986

[54] DISINFECTANT FORMULATION

[75] Inventor: David L. Coleman, Naperville, Ill.

[73] Assignee: ServiceMaster Industries, Inc., Downers Grove, Ill.

[21] Appl. No.: 595,441

[22] Filed: Mar. 30, 1984

[51] Int. Cl.[4] ..... G32B 27/30

[52] U.S. Cl. ..... 428/522; 252/106; 422/28

[58] Field of Search ..... 428/522; 252/106; 422/28

[56] References Cited

U.S. PATENT DOCUMENTS

| | | | |
|---|---|---|---|
| 2,584,056 | 1/1952 | Soule et al. | 252/106 |
| 2,599,127 | 6/1952 | Resuggan | 252/106 |
| 4,204,018 | 5/1980 | Bernstein | 428/508 |
| 4,427,558 | 1/1984 | David | 252/8.8 |
| 4,455,250 | 6/1984 | Fraizer | 252/106 |

*Primary Examiner*—Edith Buffalow

*Attorney, Agent, or Firm*—Allegretti, Newitt, Witcoff & McAndrews, Ltd.

[57] ABSTRACT

Disclosed is a polyvinylchloride tile having a nondiscoloring disinfectant coating on its surface.

10 Claims, No Drawings

DISINFECTANT FORMULATION

This invention relates to a novel disinfectant-detergent composition for polyvinylchloride surfaces which does not discolor the surface.

BACKGROUND OF THE INVENTION

In hospitals, nursing homes, schools, and other institutions, the floors are frequently covered with white or light-colored polyvinylchloride-based material in sheet form or in the form of tiles. To prevent the spreading of disease among the inhabitants of the building, the light-colored polyvinylchloride-covered floors are regularly mopped with a disinfectant-detergent solution which is effective against a broad spectrum of gram negative and gram positive bacteria, and which is virucidal and fungicidal, as well as a deodorant. The active ingredients in the disinfectant solutions of this invention are quaternary ammonium salts such as alkyl and aryl substituted ammonium chlorides.

THE PROBLEM

For some time it has been known that disinfectants formulated with quaternary ammonium compounds cause discoloration of plastic floor coverings that contain polyvinylchloride. Light-colored or white tiled floors become stained to an unsightly rust or orange color upon repeated applications of disinfectant solution containing the quaternary ammonium compounds. Stained floors are not acceptable in a hospital, for example, where gleaming white floors are desired to promote cleanliness. It appears that the polyvinylchloride is involved in the color formation, since the quaternary ammonium compounds themselves do not discolor when applied to glass or similar inert surfaces. The intensity of the color is augmented by the presence of carbonates and nonionic surfactants usually present in the disinfectant composition. It has also been observed that the discoloration is more intense and occurs at a more rapid rate with some polyvinylchloride floor coverings than with others, indicating that additives present in the polyvinylchloride formulation participate in the disagreeable discoloration. The color formation is also affected by sunlight, being more intense in areas where there is no direct sunlight. The precise mechanism responsible for the disagreeable discoloration has not been determined.

THE PRIOR ART

A disinfectant composition which produces the undesirable darkening of the plastic floor covering is an aqueous solution of quaternary ammonium chlorides which also contains the tetrasodium salt of ethylene diamine tetra acetic acid, sodium carbonate, and a nonionic surfactant. Many attempts were made to eliminate or reduce the staining of the disinfectant composition to an acceptable level. The addition of antioxidants, reducing agents, and oxygen scavengers to the disinfectant composition were not successful. Carbonate-free formulae seemed to reduce the discoloration to an acceptable level, but when tested for efficacy, none of the formulae demonstrated fungicidal activity because the pH was reduced to an unacceptable level.

All quaternary ammonium chloride-based disinfectant-detergent compounds are alkaline. Generally, the more alkaline the formulation, the more effective it is in killing microorganisms, but the more inclined it is to discolor the polyvinylchloride compositions. The closer the pH is to neutrality, the less color the formulation produces, but the less effective it is as a microbiocidal agent. So, reducing the pH does not solve the problem.

Attempts were made to remove the stains from the floor covering after formation by means of reducing agents ($NaHSO_2$ and $Na_2S_2O_3$) or oxidizing agents ($H_2O_2$ and $ClO_2$) at various pHs. None of these bleaching formulations was effective. Various other chemicals were tested to remove the stain from vinyl asbestos tile (acetic, nitric and phosphoric acids, ortho-dichlorobenzene). All were unsuccessful.

Calcium or sodium-hypochlorite with sodium hydrogen phosphate performed well in bleaching discolored tile. This bleaching composition proved to be impractical, however, because of the harmful effects of the fumes evolved during use in bleaching a floor.

THE INVENTION

In accordance with the present invention, polyvinylchloride composition tile, or similar sheet materials, can be disinfected without any significant staining or discoloration by incorporating in the quaternary ammonium solution from 3% to 15% by weight of an amino compound such as urea or guanadine hydrochloride. Urea is preferred. The pH of these formulations can be maintained at 9.5 or above for effective microbiocidal activity, while still keeping the discoloration at a minimum acceptable level. The formulations of the invention will reduce yellowing or other discoloration visible after four weeks of regular application and incubation at 35° C. to less than 15% of that resulting from the same compositions without the amino compound. Furthermore, the rate at which the discoloration takes place is substantially reduced.

The preferred disinfectant-detergent composition is an aqueous solution of a mixture of quaternary ammonium chlorides, an alkali, a nonionic surfactant, and urea. The active ingredient, quaternary ammonium chlorides, serves as a bactericide, fungicide, and virucide. A suitable commercially-available quaternary ammonium chloride contains typically octyl decyl dimethyl ammonium chloride, dioctyl dimethyl ammonium chloride, didecyl dimethyl ammonium chloride, and alkyl ($C_{14}$, 50%; $C_{12}$, 40%; $C_{16}$, 10%), dimethyl benzyl ammonium chloride. This product is sold by Lonza Chemical Company under the trademark BARDAC #BT208M, and is designated "80% active". Alkali in the form of sodium meta silicate, sodium carbonate or sodium hydroxide, is added in an amount to keep the pH of the solution preferably above 9.5 to enhance the bactericidal effect of the quaternary ammonium chlorides.

For detergent purposes, a nonionic surfactant is included in the solution. These compounds are well known and are commercially available under a number of different trademarks. Ethoxylated nonyl phenol and ethoxylated alcohol are suitable agents.

The amino compound (urea or guanadine hydrochloride) is added as a color-forming inhibitor in the amount of about 3% to 15%, based upon the total weight of the solution. Below 3% the discoloration inhibiting effect is not sufficient to keep the tile from appearing soiled. Above 15%, the amount of urea remaining on the surface of the floor after the water in the solution evaporates is objectionable. On a dry basis, the ratio of the quaternary ammonium compound to the amino compound ranges from 1:0.6 to 1:2.6. The preferred ratio is 1:2.3.

Since the floorswabbing solutions are prepared on site for use from mixtures of the ingredients in concentrated solution, tap water is usually used for dilution. Tap water in most areas of the country has a certain amount of hardness. The quaternary ammonium chlorides are not sufficiently effective antimicrobial agents in the presence of the $Ca^{++}$ or $Mg^{++}$ ions present in hard water. Consequently, a sequestering agent is included in the solution to chelate the $Ca^{++}$ and $Mg^{++}$ ions in the form of a water soluble complex. Sequestering agents are well known. Preferred agents for use in this invention include ethylene diamine tetra acetic acid (EDTA) sodium salt, sodium gluconate, sodium citrate, and citric acid. About 5% of ETDA is added to the solution, which will effectively complex up to 400 ppm of hardness.

The solutions of the invention, when diluted to between 1 and 2 oz/gal tap water, exhibit excellent detergent and disinfectant properties. The presence of the amino compound reduces color formation without the necessity of reducing the pH of the solution, and thus its effectiveness as a disinfectant. The diluted solution shows no noticable discoloration after months of regular application to light-colored plastic vinyl floor coverings.

In addition to reformulating the disinfectant-detergent composition to include the amino compound to minimize discoloration the discoloration can be further minimized by treating the light-colored polyvinylchloride floor covering with a hard floor finish, such as an acrylic or wax coating. Using the disinfectant-detergent composition in combination with this coating or finish insures no discoloration under usual conditions for disinfecting a variety of polyvinylchloride floor coverings. Such commercially-available floor finishes act as a barrier to the disinfectant solution. However, the finish by itself is not sufficiently impervious to prevent completely the disinfectant from contacting and reacting with the polyvinylchloride composition. In fact, development work was done in an attempt to find a completely impervious barrier, but the work was not successful.

SPECIFIC EXAMPLES

The effect of the amino compound in various disinfectant formulation is illustrated by the following examples.

| Ingredient | Specific Examples % by weight | | | | | |
|---|---|---|---|---|---|---|
| | Example 1 | Example 2 (prior art) | Example 3 | Example 4 | Example 5 | Example 6 (prior art) |
| Quaternary Ammonium Chloride | | | | | | |
| BARDAC 205M (50% solids) | 11.65 | — | 12.12 | 11.65 | — | 11.65 |
| ONYX-BTC 2125 M (80% solids) | — | 11.3 | — | — | 11.3 | — |
| Urea | 13.1 | — | 13.1 | 3.0 | — | — |
| Guanidine hydrochloride | — | — | — | — | 13.5 | — |
| NaOH | — | — | 0.29 | — | — | — |
| Na Meta Silicate | 0.75 | — | — | 0.75 | — | 0.75 |
| $Na_2CO_3$ | — | 4.0 | — | — | 4.0 | — |
| EDTA, tetra sodium | 2.0 | 5.0 | 2.0 | 2.0 | 5.0 | 2.0 |
| Na Citrate | 5.7 | — | 5.7 | 5.7 | — | 5.7 |
| Nonionic Surfactant (Igepol CO 710) | 2.5 | 4.0 | 2.5 | 2.5 | 4.0 | 2.5 |
| Water | 64.3 | 75.7 | 64.29 | 74.4 | 62.2 | 77.4 |
| pH | 11.6 | 12.1 | 13.2 | 12.2 | 11.6 | 12.4 |

The compositions of Example 1 and Example 6 were applied, undiluted, to the surface of a white polyvinylchloride-based asbestos tile by swabbing to simulate mopping a floor; one application each day for five days. The sample tiles thus treated, and a control sample not treated, were incubated at 35° C. in the absence of light for the five day period. The incubation accelerates color formation. At the end of the period, the "whiteness" of the surface of each sample was measured with a Hunter reflectometer. Example 1, which corresponds to the invention (with urea) and Example 6, which corresponds to the prior art, were compared with the control sample. The sample of Example 1 increased in color 18 w units, compared with the control, while the sample of Example 6 increased in color 45 w units (Hunter).

Example 3 and Example 6 solutions were applied to white vinyl asbestos tile as indicated above, except that the tiles were given one application and then incubated five days. The results were about the same, 19 w units compared with 45 w units for Example 6 (no urea).

Example 4 solution is identical to Example 1, except that the urea was reduced to 3%. Test samples treated as indicated above (one application each day for five days) were tested on the Hunter reflectometer. The sample of Example 4 exhibited 22 w units while the sample of Example 6 exhibited 45 w units.

A comparison of color development was made between Example 5 and Example 2 in the following manner in the laboratory: 200 mg of white vinyl asbestos tile comminuted in a household blender were treated with eight drops of each solution. The samples were incubated for three days in the absence of light at 35° C. The sample of Example 2 had developed a dark brownish-orange color, while the sample of Example 5 had not discolored. The determination was made by visual examination.

The solutions of Example 5 and Example 2 were diluted with tap water 1:128. White vinyl asbestos tile was treated with the diluted solution by swabbing the surface twice a day for 14 days. The samples were incubated at 35° C. after each application. After three days, visual examination indicated very slight discoloration of the sample treated with Example 5 solution, while the sample treated with Example 2 solution was much darker. After 14 days the samples were again inspected. The sample of Example 5 was slightly darker than previously, while the sample of Example 2 was very much darker—rust colored.

Another test was made comparing Examples 1 and 2 in both concentrated and diluted (1:128) form on yellow, textured white, and gray polyvinylchloride tile. Each tile was divided into four sections:

A—concentrated Example 1

B—concentrated Example 2

C—diluted Example 1

D—diluted Example 2

One application of concentrated and three applications of diluted solution were applied each day, and the tiles were incubated at 35° C. After three days, no discoloration was visible on any of the sections, but sections A did have oily residue and sections B a white residue on all three tile colors. After 28 days, sections C showed no change at all in color; sections A showed very slight discoloration (yellowish); sections B showed yellow discoloration, especially intense on the yellow tile; sections D showed slight yellow discoloration in each case. Discoloration first appeared after six days on section B of the yellow tile. After ten days, discoloration first appeared on Section B of the textured white tile.

It is usual in hospitals to mop the floors with diluted disinfectant-detergent solution five to seven times a week. Under such conditions, white polyvinylchloride-based tile showed no discoloration from the solution of the invention for twenty to thirty weeks. Where the tile was previously coated with a commercial acrylic finish there was no discoloration after about twelve months, at which time the floor was stripped and refinished.

I claim:

1. A polyvinylchloride tile having a nondiscoloring disinfectant coating on the surface thereof, the composition of said coating comprising an alkyl quaternary ammonium chloride compound and an amino compound taken from the group consisting of urea and guanadine hydrochloride, ratio of said chloride compound to said amino compound ranging from 1:0.6 to 1:2.6.

2. The tile of claim 1 in which said quaternary ammonium compound comprises octyl decyl dimethyl ammonium chloride, dioctyl dimethyl ammonium chloride, didecyl dimethyl ammonium chloride, and alkyl dimethyl benzyl ammonium chloride.

3. The tile of claim 1 in which said amino compound is urea and said ratio is 1 to 2.3.

4. A disinfectant concentrated aqueous solution for polyvinylchloride surfaces comprising 5% to 10% of a quaternary ammonium salt and from 3% to 15% of urea based upon the total weight of the solution and having a pH in excess of 11.5.

5. The solution of claim 4 including a sequestering agent and diluted with water containing less than 400 ppm of hardness.

6. The solution of claim 5 which also includes a nonionic surfactant detergent.

7. The solution of claim 6 in which said sequestering agent is ethylene diamine tetra acetic acid tetrasodium salt.

8. The tile of claim 1 which has an acrylic coating between the polyvinylchloride and the disinfectant.

9. A method for disinfecting the surface of a light-colored polyvinylchloride floor covering without discoloring said floor covering which comprises treating said surface with an aqueous solution of an alkyl quaternary ammonium chloride compound containing 3% to 15% of an amino compound taken from the group consisting of urea and guanadine hydrochloride, said solution having a pH of 9.5 or greater.

10. The tile of claim 1 in which said coating composition in aqueous solution contains sufficient alkali to provide a pH of 9.5 or greater.

* * * * *